US010308994B2

(12) United States Patent
Kawabata et al.

(10) Patent No.: US 10,308,994 B2
(45) Date of Patent: Jun. 4, 2019

(54) SEAMLESS STEEL TUBE FOR FUEL INJECTION

(71) Applicant: JFE Steel Corporation, Tokyo (JP)

(72) Inventors: Yoshikazu Kawabata, Tokyo (JP); Manabu Nishino, Handa (JP); Makio Gunji, Isehara (JP)

(73) Assignee: JFE Steel Corporation (JP)

( * ) Notice: Subject to any disclaimer, the term of this patent is extended or adjusted under 35 U.S.C. 154(b) by 263 days.

(21) Appl. No.: 15/300,810

(22) PCT Filed: Mar. 20, 2015

(86) PCT No.: PCT/JP2015/001590
§ 371 (c)(1),
(2) Date: Sep. 30, 2016

(87) PCT Pub. No.: WO2015/151448
PCT Pub. Date: Oct. 8, 2015

(65) Prior Publication Data

US 2017/0022581 A1 Jan. 26, 2017

(30) Foreign Application Priority Data

Apr. 3, 2014 (JP) ..... 2014-076850

(51) Int. Cl.

| | |
|---|---|
| ***C21D 9/14*** | (2006.01) |
| ***C21D 7/02*** | (2006.01) |
| ***C21D 1/18*** | (2006.01) |
| ***C21D 1/25*** | (2006.01) |
| ***C21D 1/28*** | (2006.01) |
| ***C21D 9/08*** | (2006.01) |
| ***C22C 38/02*** | (2006.01) |
| ***C22C 38/04*** | (2006.01) |
| ***C22C 38/06*** | (2006.01) |
| ***C22C 38/32*** | (2006.01) |
| ***C22C 38/38*** | (2006.01) |
| ***F02M 61/16*** | (2006.01) |
| ***C21D 8/10*** | (2006.01) |
| ***C22C 38/00*** | (2006.01) |
| ***C22C 38/58*** | (2006.01) |
| ***F02M 55/02*** | (2006.01) |

(52) U.S. Cl.

CPC ..... *C21D 9/14* (2013.01); *C21D 1/18* (2013.01); *C21D 1/25* (2013.01); *C21D 1/28* (2013.01); *C21D 7/02* (2013.01); *C21D 8/10* (2013.01); *C21D 8/105* (2013.01); *C22C 38/00* (2013.01); *C22C 38/06* (2013.01); *C22C 38/58* (2013.01); *F02M 55/02* (2013.01); *F02M 61/166* (2013.01); *C21D 9/08* (2013.01); *C21D 2211/001* (2013.01); *F02M 2200/9053* (2013.01)

(58) Field of Classification Search
None
See application file for complete search history.

(56) References Cited

U.S. PATENT DOCUMENTS

| | | | | |
|---|---|---|---|---|
| 2005/0076975 | A1 | 4/2005 | Lopez et al. | |
| 2009/0023506 | A1* | 1/2009 | Kondo | C21D 1/18 420/104 |
| 2009/0078341 | A1* | 3/2009 | Asada | C21D 9/14 148/328 |
| 2010/0167086 | A1* | 7/2010 | Usui | C21D 9/14 428/677 |
| 2011/0209803 | A1* | 9/2011 | Sugimoto | C21D 8/10 148/653 |
| 2012/0186704 | A1 | 7/2012 | Eguchi et al. | |
| 2012/0205016 | A1 | 8/2012 | Arai et al. | |
| 2013/0126036 | A1* | 5/2013 | Aratani | C22C 38/02 138/177 |
| 2015/0259771 | A1* | 9/2015 | Vartanov | C21D 1/25 148/318 |
| 2015/0368768 | A1* | 12/2015 | Aratani | C21D 8/105 420/83 |

FOREIGN PATENT DOCUMENTS

| | | | |
|---|---|---|---|
| JP | 2004-353028 | A | 12/2004 |
| JP | 2007-284711 | A | 11/2007 |
| JP | 2009-019503 | A | 1/2009 |
| JP | 2010-106353 | A | 5/2010 |
| JP | 2012-188729 | A | 10/2012 |

OTHER PUBLICATIONS

English translation of the Written Opinion of the International Search Authority dated Apr. 28, 2015 for PCT/JP2015/001590; 4 pages.*
English translation of JP 2004/353028, Dec. 2004; 12 pages.*
Chinese Office Action dated Apr. 6, 2017, of corresponding Chinese Application No. 201580017608.8, along with a Search Report in English.
Korean Office Action dated Sep. 5, 2017, of corresponding Korean Application No. 10-2016-7027196, along with a Concise Statement of Relevance of Office Action in English.
Supplementary European Search Report dated Dec. 12, 2016, of corresponding European Application No. 15773005.2.

* cited by examiner

*Primary Examiner* — Helene Klemanski
(74) *Attorney, Agent, or Firm* — DLA Piper LLP (US)

(57) ABSTRACT

A seamless steel tube has a particular composition and a structure with an average prior γ grain size of 150 μm or less in an axial cross-section after cold drawing and heat treatment. The structure retards the growth of a fatigue crack. The steel tube has a tensile strength TS of 500 MPa or more and good internal pressure fatigue resistance and is suitable for use as a fuel injection tube under high injection pressures. The composition of the steel tube may further contain at least one of Cu, Ni, Cr, Mo, and B; at least one of Ti, Nb, and V; and/or Ca.

8 Claims, 1 Drawing Sheet

SEAMLESS STEEL TUBE FOR FUEL INJECTION

TECHNICAL FIELD

This disclosure relates to seamless steel tubes suitable as fuel injection tubes injecting fuel into combustion chambers such as those of diesel engines. In particular, the disclosure relates to an improvement in the internal pressure fatigue resistance of seamless steel tubes used as fuel injection tubes under high pressure.

BACKGROUND

Recently, there has been a strong need to reduce $CO_2$ emissions from fuel combustion for global environmental protection. In particular, there has been a strong need to reduce $CO_2$ emissions from automobiles. Diesel engines are known as internal combustion engines with low $CO_2$ emissions and have already been used as automotive engines. Although diesel engines have low $CO_2$ emissions, they have a problem in that they tend to emit black smoke.

Diesel engines emit black smoke when there is a lack of oxygen for the fuel injected. The black smoke contributes to air pollution and is harmful to humans. Accordingly, it has been attempted to inject fuel into a combustion chamber of a diesel engine at a higher pressure since the injection of fuel into a combustion chamber of a diesel engine at a higher pressure reduces emissions of black smoke. However, injection of fuel into a combustion chamber at a higher pressure requires a fuel injection tube with a higher internal pressure fatigue strength.

To address this need, for example, Japanese Patent No. 5033345 (Japanese Unexamined Patent Application Publication No. 2007-284711) discloses a steel tube for fuel injection that contains, by mass, 0.12% to 0.27% C, 0.05% to 0.40% Si, 0.8% to 2.0% Mn, and at least one of 1% or less Cr, 1% or less Mo, 0.04% or less Ti, 0.04% or less Nb, and 0.1% or less V and that contains, as impurities, 0.001% or less Ca, 0.02% or less P, and 0.01% or less S. The steel tube has a tensile strength of 500 N/mm$^2$ (500 MPa) or more and contains nonmetallic inclusions having maximum diameters of 20 μm or less at least from the inner surface of the steel tube to a depth of 20 μm. JP '345 discloses that the technique allows the injection of fuel into a combustion chamber at a higher pressure to reduce emissions of black smoke while reducing $CO_2$ emissions.

Japanese Patent No. 5065781 (Japanese Unexamined Patent Application Publication No. 2009-19503) discloses a seamless steel tube for fuel injection that contains, by mass, 0.12% to 0.27% C, 0.05% to 0.40% Si, 0.8% to 2.0% Mn, and optionally at least one of 1% or less Cr, 1% or less Mo, 0.04% or less Ti, 0.04% or less Nb, and 0.1% or less V and that contains, as impurities, 0.001% or less Ca, 0.02% or less P, and 0.01% or less S. The steel tube has a tensile strength of 900 N/mm$^2$ (900 MPa) or more and contains nonmetallic inclusions having maximum diameters of 20 μm or less at least from the inner surface of the steel tube to a depth of 20 μm. The technique disclosed in JP '781 involves hardening the steel tube at or above the $Ac_3$ transformation temperature and tempering the steel tube at or below the $Ac_1$ transformation temperature to achieve a tensile strength of 900 N/mm$^2$ or more. JP '781 discloses that the technique prevents fatigue failure initiated from a nonmetallic inclusion present near the inner surface and thus allows for a high critical internal pressure while providing a high tensile strength of 900 N/mm$^2$ or more so that no fatigue occurs when fuel is injected into a combustion chamber at a higher pressure.

JP '345 and JP '781 disclose that the steel tubes contain no nonmetallic inclusions having maximum diameters of more than 20 μm at least from the inner surfaces of the steel tubes to a depth of 20 μm. However, the techniques disclosed in JP '345 and JP '781 have many problems with stable manufacture of steel tubes containing nonmetallic inclusions having maximum diameters of 20 μm or less at least from the inner surfaces of the steel tubes to a depth of 20 μm. Specifically, it is difficult to stably manufacture seamless steel tubes for fuel injection with high strength and good internal pressure fatigue resistance.

It could therefore be helpful to stably provide a seamless steel tube for fuel injection with high strength and good internal pressure fatigue resistance.

SUMMARY

We thus provide:

[1] A seamless steel tube for fuel injection has a composition containing, by mass, 0.155% to 0.38% C, 0.01% to 0.49% Si, 0.6% to 2.1% Mn, 0.005% to 0.25% Al, and 0.0010% to 0.010% N and containing, as impurities, 0.030% or less P, 0.025% or less S, and 0.005% or less O, the balance being Fe and incidental impurities. The composition satisfies condition (1):

$$[\text{Al }\%]\times[\text{N }\%]\leq 27\times10^{-5} \quad (1)$$

where Al % and N % are the contents (% by mass) of Al and N, respectively. The steel tube has a structure with an average prior γ grain size of 150 μm or less in an axial cross-section after cold drawing and heat treatment and has a tensile strength TS of 500 MPa or more.

[2] The composition of the seamless steel tube for fuel injection according to Item [1] further contains, by mass, at least one of 0.10% to 0.70% Cu, 0.01% to 1.0% Ni, 0.1% to 1.2% Cr, 0.03% to 0.50% Mo, and 0.0005% to 0.0060% B.

[3] The composition of the seamless steel tube for fuel injection according to Item [1] or [2] further contains, by mass, at least one of 0.005% to 0.20% Ti, 0.005% to 0.050% Nb, and 0.005% to 0.20% V.

[4] The composition of the seamless steel tube for fuel injection according to any one of Items [1] to [3] further contains, by mass, 0.0005% to 0.0040% Ca.

An industrially significant advantage of our tubes is that a seamless steel tube with high strength and good internal pressure fatigue resistance suitable as a fuel injection tube can be easily manufactured at low cost. Another advantage is that the steel tube has improved internal pressure fatigue resistance and can be used as a fuel injection tube under a higher inner pressure than before since a fatigue crack initiated from an inclusion present near the surface does not substantially grow and becomes non-propagating.

DETAILED DESCRIPTION

The term "good internal pressure fatigue resistance" refers to an endurance ratio of 30% or more, which is the ratio σ/TS of stress σ to tensile strength TS. Preferably, the endurance ratio is 35% or more. The stress σ is calculated by the following equation:

σ=inner diameter (mm)×internal pressure fatigue strength (MPa)/(2×wall thickness) (mm)

where the inner diameter and the wall thickness are the target inner diameter and wall thickness, respectively, of the fuel injection tube.

Test specimens were taken from steel tubes (34 mm in outer diameter and 25 mm in inner diameter) containing, by mass, about 0.17% C, about 0.26% Si, about 1.27% Mn, about 0.03% Cr, about 0.013% Ti, about 0.036% Nb, about 0.037% V, about 0.004% to 0.30% Al, and about 0.0005% to 0.011% N. The test specimens were repeatedly cold-drawn to obtain as-drawn tubes (6.4 mm in outer diameter and 3.0 mm in inner diameter). The as-drawn tubes were heat-treated (heated to 1,000° C. and then allowed to cool) to obtain steel tubes with a tensile strength TS of 560 MPa. The resulting steel tubes had prior γ grain sizes (average prior γ grain sizes) of 80 to 200 μm in an axial cross-section. These steel tubes were subjected to an internal pressure fatigue test.

In the internal pressure fatigue test, the internal pressure fatigue strength was determined as the maximum internal pressure at which no fatigue failure occurred after a sinusoidal pressure (minimum internal pressure: 18 MPa, maximum internal pressure: 250 to 190 MPa) was applied for $10^7$ cycles.

Figure 1:
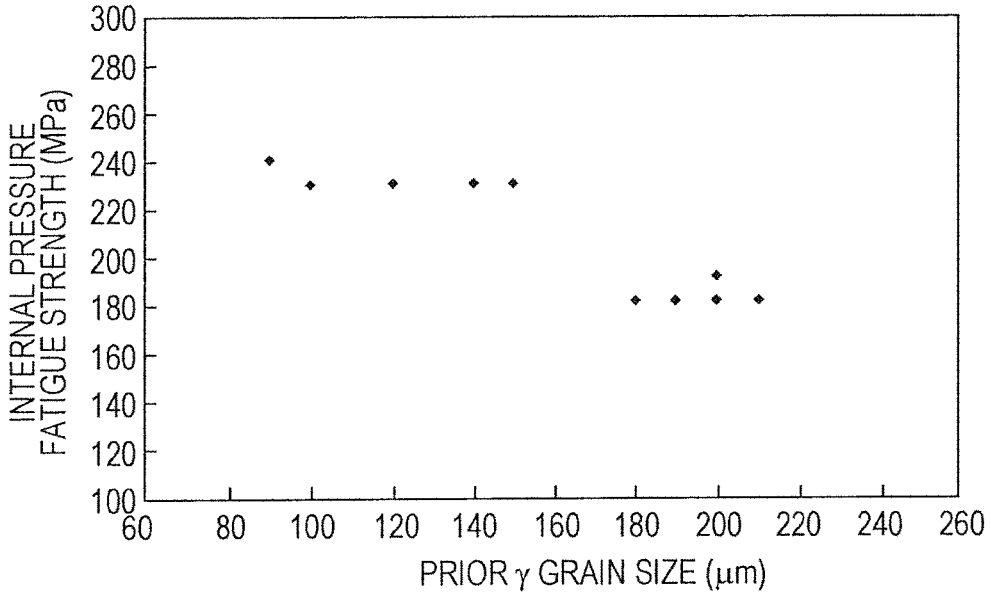
FIG. 1 is a graph showing the effect of prior γ grain size on internal pressure fatigue strength.

The results are shown in FIG. 1 as the relationship between internal pressure fatigue strength and prior γ grain size. As can be seen from FIG. 1, smaller prior γ grain sizes result in higher internal pressure fatigue strengths. Examination of the growth behavior of a fatigue crack initiated from an inclusion also revealed that even a fatigue crack initiated from an inclusion with a maximum diameter of more than 20 μm does not substantially grow and becomes non-propagating if the prior γ grain size is 150 μm or less (plots for compositions within the scope of the disclosure lie in a range of prior γ grain sizes of 150 μm or less).

Although the mechanism has yet to be fully understood, we believe that the following mechanism applies.

A crack (fatigue crack) grows while breaking the material at the tip thereof under repeated stress perpendicular to the crack growth direction. Due to the repeated stress, the material generally hardens around the tip of the crack and breaks without being substantially elongated. The material, however, may deform to some extent before breaking if the hardened zone around the tip of the crack is small. The deformed, elongated region around the tip of the crack closes the crack and retards the growth thereof so that it may become non-propagating, i.e., stop propagating. If the material has a fine structure with a prior γ grain size of 150 μm or less, the hardened zone around the tip of the crack becomes smaller since the stress transferred to the surrounding region is reduced by factors such as subgrain boundaries, grain boundaries, crystal misorientations, and precipitates. This facilitates deformation in the breaking zone during crack growth and thus increases the amount of elongation so that the crack is more likely to become non-propagating.

However, heat treatment after cold drawing tends to coarsen γ grains. Accordingly, we used Test Specimens B to Q of the Examples in Table 1 and discovered that, to achieve a small prior γ grain size, i.e., 150 μm or less, after cold drawing and heat treatment, it is necessary to control the Al content and the N content to proper ranges and to control [Al %]×[N %] to a proper range.

Figure 2:
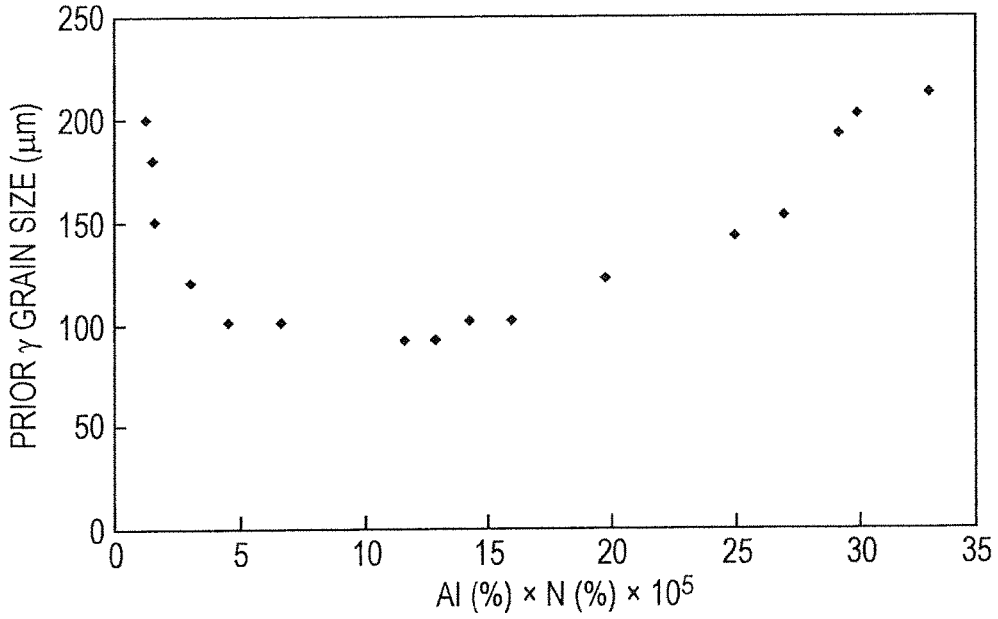
FIG. 2 is a graph showing the effect of [Al %]×[N %] on prior γ grain size.

FIG. 2 shows the relationship between prior γ grain size and [Al %]×[N %]. As can be seem from FIG. 2, [Al %]×[N %] needs to be controlled to $27\times10^{-5}$ or less to achieve a prior γ grain size of 150 μm or less (plots for compositions within the scope of the disclosure lie in a range of [Al %]×[N %] of $27\times10^{-5}$ or less). Preferably, [Al %]×[N %] is $2\times10^{-5}$ or more.

Our seamless steel tube for fuel injection (herein also referred to as "seamless steel tube") has a composition containing, by mass, 0.155% to 0.38% C, 0.01% to 0.49% Si, 0.6% to 2.1% Mn, 0.005% to 0.25% Al, and 0.0010% to 0.010% N and containing, as impurities, 0.030% or less P, 0.025% or less S, and 0.005% or less O, the balance being Fe and incidental impurities. The composition satisfies [Al %]×[N %]≤$27\times10^{-5}$ (where Al % and N % are the contents (% by mass) of Al and N, respectively).

The seamless steel tube also has a structure with a prior γ grain size of 150 μm or less in an axial cross-section after cold drawing and heat treatment.

The seamless steel tube also has a tensile strength TS of 500 MPa or more.

The reasons for the limitations on the composition of the seamless steel tube will now be described, where percentages are by mass unless otherwise indicated.

C: 0.155% to 0.38%

C is an element that increases the strength of the steel tube by dissolving, precipitating, and improving hardenability. To achieve the desired high hardness through these effects, C needs to be present in an amount of 0.155% or more. A C content exceeding 0.38%, however, deteriorates the hot workability and makes it difficult to form a steel tube of predetermined size and shape. The C content is therefore limited to 0.155% to 0.38%. A preferred C content is 0.16% to 0.21%.

Si: 0.01% to 0.49%

Si is an element that serves as a deoxidizer. Si needs to be present in an amount of 0.01% or more to achieve this effect. A Si content exceeding 0.49%, however, has no further effect and is economically disadvantageous. The Si content is therefore limited to 0.01% to 0.49%. A preferred Si content is 0.15% to 0.35%.

Mn: 0.6% to 2.1%

Mn is an element that increases the strength of the steel tube by dissolving and improving hardenability. Mn needs to be present in an amount of 0.6% or more to achieve the desired high hardness through these effects. A Mn content exceeding 2.1%, however, promotes segregation and thus deteriorates the toughness of the steel tube. The Mn content is therefore limited to 0.6% to 2.1%. A preferred Mn content is 1.20% to 1.40%.

Al: 0.005% to 0.25%

Al is an element that serves as a deoxidizer and also contributes effectively to the refinement of crystal grains, particularly γ grains, by combining with N to precipitate AlN, which refines the crystal grains and thereby improves the internal pressure fatigue resistance. Al needs to be present in an amount of 0.005% or more to achieve these effects. An Al content exceeding 0.25%, however, coarsens AlN precipitates. Such precipitates cannot refine the crystal grains to the desired level and thus cannot provide the desired high toughness and good internal pressure fatigue resistance. A preferred Al content is 0.015% to 0.050%.

N: 0.0010% to 0.010%

N is an element that contributes effectively to the refinement of crystal grains, particularly γ grains, by combining with Al to precipitate AlN, which refines the crystal grains and thereby improves the internal pressure fatigue resistance. N needs to be present in an amount of 0.0010% or more to achieve this effect. A N content exceeding 0.010%, however, coarsens AlN precipitates. Such precipitates cannot refine the crystal grains to the desired level. The N content is therefore limited to 0.0010% to 0.010%. A N content of 0.0020% to 0.0050% is preferred for reasons of age hardening, which deteriorates the cold drawability.

$$[Al\ \%]\times[N\ \%]\leq 27\times10^{-5} \quad (1)$$

Satisfying condition (1) by controlling the product of the Al content [Al %] and the N content [N %] ([Al %]×[N %]) reduces the prior γ grain size to a predetermined level or lower and thus improves the toughness and internal pressure fatigue resistance of the steel tube. A value of [Al %]×[N %] exceeding $27\times10^{-5}$, which does not satisfy condition (1), coarsens AlN precipitates. Such precipitates are less effective in refining the crystal grains and thus cannot provide the desired internal pressure fatigue resistance. The Al content [Al %] and the N content [N %] are therefore controlled so that [Al %]×[N %] satisfies condition (1). A preferred value of [Al %]×[N %] is $20\times10^{-5}$ or less.

The composition of the seamless steel tube contains, as impurities, 0.030% or less P, 0.025% or less S, and 0.005% or less O.

It is desirable to minimize the contents of P, S, and O, which are detrimental to hot workability and toughness. 0.030% or less P, 0.025% or less S, and 0.005% or less O can be tolerated. The contents of P, S, and O, which are impurities, are therefore controlled as follows: the P content is 0.030% or less, the S content is 0.025% or less, and the O content is 0.005% or less.

In addition to the basic constituents described above, the composition of the seamless steel tube may optionally contain at least one of 0.70% or less Cu, 1.00% or less Ni, 1.20% or less Cr, 0.50% or less Mo, and 0.0060% or less B; at least one of 0.20% or less Ti, 0.050% or less Nb, and 0.20% or less V; and/or 0.0040% or less Ca.

At Least One of 0.70% or Less Cu, 1.00% or Less Ni, 1.20% or Less Cr, 0.50% or Less Mo, and 0.0060% or Less B Cu, Ni, Cr, Mo, and B are elements that contribute to increased strength by improving hardenability. At least one of these elements may optionally be added.

Cu is an element that contributes to improved toughness in addition to increased strength and may optionally be added. A Cu content of 0.03% or more is preferred to achieve these effects. Cu needs to be present in an amount of 0.10% or more to achieve sufficient effectiveness. A Cu content exceeding 0.70% deteriorates the hot workability and also increases the residual γ content and thus decreases the strength. If Cu is added, therefore, the Cu content is preferably limited to 0.03% to 0.70%. A more preferred Cu content is 0.20% to 0.60%.

Ni is an element that contributes to improved toughness in addition to increased strength and may optionally be added. Ni needs to be present in an amount of 0.10% or more to achieve these effects. In view of this, a Ni content of 0.10% or more is preferred. A Ni content exceeding 1.00% increases the residual γ content and thus decreases the strength. If Ni is added, therefore, the Ni content is preferably limited to 0.10% to 1.00%. A more preferred Ni content is 0.20% to 0.60%.

Cr is an element that contributes to increased strength and may optionally be added. A Cr content of 0.02% or more is preferred to achieve this effect. Cr needs to be present in an amount of 0.1% or more to achieve sufficient effectiveness. A Cr content exceeding 1.20% results in formation of extremely coarse carbonitrides and may thus decrease the fatigue strength of the seamless steel tube, even though the steel tube is less susceptible to coarse precipitates and inclusions. If Cr is added, therefore, the Cr content is preferably limited to 0.02% to 1.20%. A more preferred Cr content is 0.02% to 0.40%.

Mo is an element that contributes to improved toughness in addition to increased strength and may optionally be added. Mo needs to be present in an amount of 0.03% or more to achieve these effects. A Mo content of 0.03% or more is preferred. A Mo content exceeding 0.50% results in formation of extremely coarse carbonitrides and may thus decrease the fatigue strength of the seamless steel tube even though the steel tube is less susceptible to coarse precipitates and inclusions. If Mo is added, therefore, the Mo content is preferably limited to 0.03% to 0.50%. A more preferred Mo content is 0.04% to 0.35%.

B is an element that contributes to improved hardenability even when present in very small amounts and may optionally be added. B needs to be present in an amount of 0.0005% or more to achieve this effect. A B content of 0.0005% or more is preferred. A B content exceeding 0.0060% has no further effect and may deteriorate hardenability. If B is added, therefore, the B content is preferably limited to 0.0005% to 0.0060%. A more preferred B content is 0.0010% to 0.0030%.

At Least One of 0.20% or Less Ti, 0.050% or Less Nb, and 0.20% or Less V

Ti, Nb, and V are elements that contribute to increased strength by precipitation strengthening. At least one of these elements may optionally be added.

Ti is an element that contributes to improved toughness in addition to increased strength and may optionally be added. Ti needs to be present in an amount of 0.005% or more to achieve these effects. A Ti content of 0.005% or more is preferred. A Ti content exceeding 0.20% results in formation of extremely coarse carbonitrides and may thus decrease the fatigue strength of the seamless steel tube even though the steel tube is less susceptible to coarse precipitates and inclusions. If Ti is added, therefore, the Ti content is preferably limited to 0.005% to 0.20%. A more preferred Ti content is 0.005% to 0.020%.

Nb, as with Ti, is an element that contributes to improved toughness in addition to increased strength and may optionally be added. Nb needs to be present in an amount of 0.005% or more to achieve these effects. An Nb content of 0.005% or more is preferred. A Nb content exceeding 0.050% results in formation of extremely coarse carbonitrides and may thus decrease the fatigue strength of the seamless steel tube even though the steel tube is less susceptible to coarse precipitates and inclusions. If Nb is added, therefore, the Nb content is preferably limited to 0.005% to 0.050%. A more preferred Nb content is 0.020% to 0.050%.

V is an element that contributes to increased strength and may optionally be added. V needs to be present in an amount of 0.005% or more to achieve this effect. A V content of 0.005% or more is preferred. A V content exceeding 0.20% results in formation of extremely coarse carbonitrides and may thus decrease the fatigue strength of the seamless steel tube even though the steel tube is less susceptible to coarse precipitates and inclusions. If V is added, therefore, the V content is preferably limited to 0.005% to 0.20%. A more preferred V content is 0.025% to 0.060%.

Ca: 0.0040% or Less

Ca is an element that contributes to the morphology control of inclusions and may optionally be added.

Ca is an element that contributes to improved ductility, toughness, and corrosion resistance by controlling the morphology of inclusions so that they are finely dispersed. Ca needs to be present in an amount of 0.0005% or more to achieve this effect. A Ca content of 0.0005% or more is preferred. A Ca content exceeding 0.0040% results in formation of extremely coarse inclusions and may thus decrease the fatigue strength of the seamless steel tube even though the steel tube is less susceptible to coarse precipitates and inclusions. Such a high Ca content may also deteriorate the corrosion resistance. If Ca is added, therefore, the Ca content is preferably limited to 0.0005% to 0.0040%. A more preferred Ca content is 0.0005% to 0.0015%.

In addition to the constituents described above, the balance is Fe and incidental impurities.

The structure of the seamless steel tube will now be described.

The seamless steel tube, which has the composition described above, has a structure composed of at least one of ferrite, pearlite, bainitic ferrite (including acicular ferrite), bainite, and martensite phase (including tempered martensite) with a prior γ grain size of 150 μm or less in an axial cross-section after cold drawing and heat treatment.

The prior γ grain size is limited to 150 μm or less, which means a fine structure. Such a fine structure improves the internal pressure fatigue resistance since an internal pressure fatigue crack grows slowly through the structure and may become non-propagating, i.e., stop propagating. A prior γ grain size exceeding 150 μm coarsens the structure and thus deteriorates the internal pressure fatigue resistance. The prior γ grain size is therefore limited to 150 μm or less. A preferred prior γ grain size is 100 μm or less.

The prior γ grain size is determined in accordance with JIS G 0511 as follows. The prior γ grain size of a structure composed of bainitic ferrite phase (including acicular ferrite phase), bainite phase, or martensite phase (including tempered martensite) is determined by etching the structure with a saturated aqueous picric acid solution and examining the revealed structure. The prior γ grain size of a structure where ferrite-pearlite structure and proeutectoid ferrite are observed is determined by etching the structure with nital and measuring the cell size of the revealed ferrite network.

A preferred method of manufacturing the seamless steel tube will now be described.

The seamless steel tube is manufactured using a steel tube material having the composition described above as a starting material. The steel tube material used may be manufactured by any process, and any common process may be used. For example, a molten steel having the composition described above is preferably prepared by a common melting process such as using a steel making converter or vacuum melting furnace and then cast into a semi-finished product (steel tube material) such as a round billet by a common casting process such as continuous casting. Alternatively, the steel tube material may be manufactured by hot-working a continuously cast semi-finished product to the desired size and shape. It should also be understood that the steel tube material may be manufactured by ingot casting and cogging.

The resulting steel tube material is preferably heated, pierced and elongated through a Mannesmann plug mill type or Mannesmann mandrel mill type rolling mill, and optionally subjected to a process such as sizing through a stretch reducer to form a seamless steel tube of predetermined size.

For piercing and elongating, the steel tube material is preferably heated to 1,100° C. to 1,300° C.

A steel tube material heated below 1,100° C. has high deformation resistance and is thus difficult to pierce or cannot be pierced to a suitable size. A steel tube material heated above 1,300° C. gives a low manufacturing yield due to increased oxidation loss and also has poor properties due to coarse crystal grains. A heating temperature preferred for piercing is therefore 1,100° C. to 1,300° C. A more preferred heating temperature is 1,150° C. to 1,250° C.

In the tube-forming process, the steel tube material is pierced and elongated through a common Mannesmann plug mill type or Mannesmann mandrel mill type rolling mill and then optionally subjected to a process such as sizing through a stretch reducer to form a seamless steel tube of predetermined size. Alternatively, the steel tube material may be hot-extruded through a press to form a seamless steel tube.

The resulting seamless steel tube is optionally repeatedly subjected to a process such as cold drawing to a predetermined size and then heat-treated to obtain a seamless steel tube having the desired high tensile strength, i.e., 500 MPa or more. Prior to cold drawing, the as-formed tube is preferably subjected to a process such as boring to remove initial surface defects. The inner surface of the cold-drawn tube is preferably subjected to a process such as chemical polishing to remove surface defects such as wrinkles resulting from cold drawing.

In the heat treatment process, the steel tube may be normalized or hardened and tempered to achieve a predetermined strength.

In the normalizing process, the steel tube is preferably heated to 850° C. to 1,150° C. for 30 minutes or less and then cooled at a cooling rate similar to that of air cooling, i.e., about 2° C./sec. to 5° C./sec. A heating temperature below 850° C. does not give the desired strength. A high heating temperature above 1,150° C. and a long heating time exceeding 30 minutes coarsen the crystal grains and thus decrease the fatigue strength.

In the hardening process, the steel tube is preferably heated to 850° C. to 1,150° C. for 30 minutes or less and then cooled at a cooling rate exceeding 5° C./sec. A hardening heating temperature below 850° C. does not give the desired high strength. A high heating temperature above 1,150° C. and a long heating time exceeding 30 minutes may coarsen the crystal grains and may thus decrease the fatigue strength.

In the tempering process, the steel tube is preferably heated to the $Ac_1$ transformation temperature or lower, more preferably 450° C. to 650° C., and then air-cooled. A tempering temperature exceeding the $Ac_1$ transformation temperature does not stably give the desired properties. To achieve a high strength of 780 MPa or more, the steel tube is preferably hardened and tempered.

The heat treatment conditions are properly controlled to achieve a prior γ grain size of 150 μm or less. As discussed above, heat treatment following repeated cold drawing tends to coarsen γ grains, unlike simple heat treatment of hot-rolled or cold-rolled sheets. There would therefore be no proper heat treatment conditions unless the chemical composition is properly controlled.

EXAMPLES

Steel tube materials having the compositions shown in Table 1 were heated to 1,150° C. to 1,250° C., pierced and elongated through a Mannesmann mandrel mill type rolling mill, and sized through a stretch reducer to form seamless steel tubes (34 mm in diameter and 25 mm in inner diameter). These seamless steel tubes were repeatedly cold-drawn to form cold-drawn steel tubes (6.4 mm in outer diameter and 3.0 mm in inner diameter). The resulting cold-drawn steel tubes were heat-treated as shown in Table 2.

Test specimens were taken from the resulting seamless steel tubes (cold-drawn steel tubes) and subjected to structural examination, a tensile test, and an internal pressure fatigue test. The test procedures are as follows.

(1) Structural Examination

Test specimens for structural examination were taken from the resulting steel tubes. These test specimens were polished so that they could be examined in a cross-section perpendicular to the axial direction (axial cross-section) and were etched with an etchant (saturated aqueous picric acid solution or nital) in accordance with JIS G 0511. The revealed structure was observed and imaged under an optical microscope (at 200× magnification). The image was analyzed to calculate the average prior γ grain size of the steel tube. Nos. 1 to 17 and Nos. 20 to 26 were etched with a saturated aqueous picric acid solution. Nos. 18 and 19 were etched with nital, and the prior γ grain size was determined as the cell size of the ferrite network.

(2) Tensile Test

JIS No. 11 test specimens were taken from the resulting steel tubes so that they could be pulled in the axial direction. These test specimens were subjected to a tensile test in accordance with JIS Z 2241 to determine the tensile properties (tensile strength TS).

(3) Internal Pressure Fatigue Test

Test specimens (tubes) for an internal pressure fatigue test were taken from the resulting steel tubes. These test specimens were subjected to an internal pressure fatigue test. In the internal pressure fatigue test, the internal pressure fatigue strength was determined as the maximum internal pressure at which no failure occurred after a sinusoidal pressure (internal pressure) was applied to the interior of the tube for $10^7$ cycles. The sinusoidal pressure (internal pressure) had a minimum internal pressure of 18 MPa and a maximum internal pressure of 250 to 190 MPa.

The results are summarized in Table 2.

TABLE 1

| Steel | Chemical composition (% by mass) | | | | | | | | |
|---|---|---|---|---|---|---|---|---|---|
| No. | C | Si | Mn | Al | N | P | S | O | [Al %] × [N %] |
| A | 0.17 | 0.26 | 1.27 | 0.030 | 0.0032 | 0.014 | 0.002 | 0.0016 | $10 \times 10^{-5}$ |
| B | 0.17 | 0.26 | 1.28 | 0.004 | 0.0030 | 0.016 | 0.003 | 0.0015 | $1 \times 10^{-5}$ |
| C | 0.17 | 0.27 | 1.28 | 0.005 | 0.0031 | 0.016 | 0.004 | 0.0017 | $2 \times 10^{-5}$ |
| D | 0.17 | 0.26 | 1.27 | 0.015 | 0.0030 | 0.014 | 0.004 | 0.0014 | $5 \times 10^{-5}$ |
| E | 0.17 | 0.26 | 1.27 | 0.035 | 0.0033 | 0.017 | 0.001 | 0.0017 | $12 \times 10^{-5}$ |
| F | 0.18 | 0.27 | 1.27 | 0.050 | 0.0032 | 0.015 | 0.003 | 0.0013 | $16 \times 10^{-5}$ |
| G | 0.17 | 0.26 | 1.27 | 0.060 | 0.0033 | 0.016 | 0.002 | 0.0014 | $20 \times 10^{-5}$ |
| H | 0.18 | 0.26 | 1.28 | 0.250 | 0.0010 | 0.015 | 0.002 | 0.0016 | $25 \times 10^{-5}$ |
| I | 0.18 | 0.27 | 1.27 | 0.300 | 0.0010 | 0.017 | 0.002 | 0.0017 | $30 \times 10^{-5}$ |
| J | 0.17 | 0.26 | 1.28 | 0.030 | 0.0005 | 0.015 | 0.002 | 0.0017 | $2 \times 10^{-5}$ |
| K | 0.18 | 0.26 | 1.28 | 0.030 | 0.0010 | 0.016 | 0.003 | 0.0017 | $3 \times 10^{-5}$ |
| L | 0.17 | 0.27 | 1.27 | 0.030 | 0.0022 | 0.013 | 0.003 | 0.0013 | $7 \times 10^{-5}$ |
| M | 0.17 | 0.27 | 1.28 | 0.032 | 0.0040 | 0.015 | 0.001 | 0.0013 | $13 \times 10^{-5}$ |
| N | 0.17 | 0.26 | 1.28 | 0.029 | 0.0049 | 0.016 | 0.001 | 0.0017 | $14 \times 10^{-5}$ |
| O | 0.17 | 0.27 | 1.28 | 0.027 | 0.0100 | 0.013 | 0.003 | 0.0014 | $27 \times 10^{-5}$ |
| P | 0.17 | 0.26 | 1.28 | 0.043 | 0.0068 | 0.015 | 0.003 | 0.0014 | $29 \times 10^{-5}$ |
| Q | 0.18 | 0.27 | 1.27 | 0.030 | 0.0110 | 0.016 | 0.001 | 0.0014 | $33 \times 10^{-5}$ |
| R | 0.08 | 0.26 | 1.28 | 0.030 | 0.0030 | 0.015 | 0.004 | 0.0016 | $9 \times 10^{-5}$ |
| S | 0.17 | 0.26 | 0.50 | 0.030 | 0.0030 | 0.017 | 0.004 | 0.0015 | $9 \times 10^{-5}$ |
| T | 0.17 | 0.27 | 2.20 | 0.030 | 0.0030 | 0.015 | 0.002 | 0.0014 | $9 \times 10^{-5}$ |
| U | 0.16 | 0.15 | 1.45 | 0.028 | 0.0032 | 0.014 | 0.004 | 0.0015 | $9 \times 10^{-5}$ |
| V | 0.21 | 0.44 | 1.44 | 0.034 | 0.0030 | 0.016 | 0.005 | 0.0014 | $10 \times 10^{-5}$ |
| W | 0.18 | 0.34 | 1.47 | 0.030 | 0.0043 | 0.014 | 0.003 | 0.0017 | $13 \times 10^{-5}$ |
| X | 0.13 | 0.29 | 1.46 | 0.036 | 0.0046 | 0.014 | 0.001 | 0.0015 | $17 \times 10^{-5}$ |
| Y | 0.23 | 0.28 | 1.57 | 0.015 | 0.0076 | 0.013 | 0.003 | 0.0013 | $11 \times 10^{-5}$ |
| Z | 0.18 | 0.21 | 0.75 | 0.035 | 0.0076 | 0.016 | 0.005 | 0.0015 | $27 \times 10^{-5}$ |

| Steel | Chemical composition (% by mass) | | | |
|---|---|---|---|---|
| No. | Cu, Ni, Cr. Mo, B | Ti, Nb. V | Ca | Remarks |
| A | — | — | — | Example |
| B | Cr: 0.04, | Ti: 0.013, Nb: 0.036, V: 0.037 | — | Comparative Example |
| C | Cr: 0.04, | Ti: 0.014, Nb: 0.036, V: 0.036 | — | Example |
| D | Cr: 0.04, | Ti: 0.014, Nb: 0.035, V: 0.036 | — | Example |
| E | Cr: 0.03, | Ti: 0.014, Nb: 0.036, V: 0.036 | — | Example |
| F | Cr: 0.03, | Ti: 0.014, Nb: 0.037, V: 0.038 | — | Example |
| G | Cr: 0.04, | Ti: 0.013, Nb: 0.035, V: 0.036 | — | Example |
| H | Cr: 0.03, | Ti: 0.014, Nb: 0.035, V: 0.038 | — | Example |
| I | Cr: 0.04, | Ti: 0.013, Nb: 0.036, V: 0.038 | — | Comparative Example |
| J | Cr: 0.04, | Ti: 0.014, Nb: 0.036, V: 0.037 | — | Comparative Example |
| K | Cr: 0.04, | Ti: 0.013, Nb: 0.036, V: 0.036 | — | Example |
| L | Cr: 0.04, | Ti: 0.014, Nb: 0.036, V: 0.036 | — | Example |
| M | Cr: 0.03, | Ti: 0.014, Nb: 0.036, V: 0.038 | — | Example |

TABLE 1-continued

| | | | | |
|---|---|---|---|---|
| N | Cr: 0.03, | Ti: 0.013, Nb: 0.035, V: 0.037 | — | Example |
| O | Cr: 0.04, | Ti: 0.014, Nb: 0.035, V: 0.037 | — | Example |
| P | Cr: 0.03, | Ti: 0.014, Nb: 0.036, V: 0.038 | — | Comparative Example |
| Q | Cr: 0.04, | Ti: 0.014, Nb: 0.035, V: 0.037 | — | Comparative Example |
| R | Cr: 0.03, | Ti: 0.014, Nb: 0.037, V: 0.037 | — | Comparative Example |
| S | Cr: 0.04, | Ti: 0.014, Nb: 0.036, V: 0.037 | — | Comparative Example |
| T | Cr: 0.04, | Ti: 0.014, Nb: 0.036, V: 0.036 | — | Comparative Example |
| U | Cu: 0.42, Ni: 0.37 | Ti: 0.012, V: 0.067 | — | Example |
| V | Cr: 0.28, | Ti: 0.010, V: 0.084 | — | Example |
| W | Mo: 0.18, B: 0.0056 | Ti: 0.023, V: 0.063 | — | Example |
| X | Cu: 0.03, Ni: 0.10, Cr: 0.05 | V: 0.046 | 0.0013 | Example |
| Y | B: 0.0029 | V: 0.148 | 0.0016 | Example |
| Z | Cr: 0.97, Mo: 0.18 | — | — | Example |

TABLE 2

| | | Heat treatment | | | | | |
|---|---|---|---|---|---|---|---|
| | | Normalizing | | Hardening | | Tempering | |
| Steel tube No. | Steel No. | Heating temperature (° C.) | Holding time (min) | Heating temperature (° C.) | Holding time (sec) | Heating temperature (° C.) | Holding time (min) |
| 1 | A | — | — | 1000 | 600 | 500 | 20 |
| 2 | B | 1000 | 8 | — | — | — | — |
| 3 | C | 1000 | 8 | — | — | — | — |
| 4 | D | 1000 | 8 | — | — | — | — |
| 5 | E | 1000 | 8 | — | — | — | — |
| 6 | F | 1000 | 8 | — | — | — | — |
| 7 | G | 1000 | 8 | — | — | — | — |
| 8 | H | 1000 | 8 | — | — | — | — |
| 9 | I | 1000 | 8 | — | — | — | — |
| 10 | J | 1000 | 8 | — | — | — | — |
| 11 | K | 1000 | 8 | — | — | — | — |
| 12 | L | 1000 | 8 | — | — | — | — |
| 13 | M | 1000 | 8 | — | — | — | — |
| 14 | N | 1000 | 8 | — | — | — | — |

TABLE 2-continued

| | | Heat treatment | | | | | |
|---|---|---|---|---|---|---|---|
| | | Normalizing | | Hardening | | Tempering | |
| Steel tube No. | Steel No. | Heating temperature (° C.) | Holding time (min) | Heating temperature (° C.) | Holding time (sec) | Heating temperature (° C.) | Holding time (min) |
| 15 | O | 1000 | 8 | — | — | — | — |
| 16 | P | 1000 | 8 | — | — | — | — |
| 17 | Q | 1000 | 8 | — | — | — | — |
| 18 | R | 1000 | 8 | — | — | — | — |
| 19 | S | 1000 | 8 | — | — | — | — |
| 20 | T | 1000 | 8 | — | — | — | — |
| 21 | U | 1100 | 20 | — | — | — | — |
| 22 | V | 900 | 20 | — | — | — | — |
| 23 | W | — | — | 1150 | 1 | 450 | 20 |
| 24 | X | 850 | 30 | — | — | — | — |
| 25 | Y | 1000 | 20 | — | — | — | — |
| 26 | Z | — | — | 1000 | 600 | 450 | 20 |

TABLE 3

| | | Structure | | Tensile properties | Internal pressure fatigue resistance | | | |
|---|---|---|---|---|---|---|---|---|
| Steel tube No. | Steel No. | Type of main phase* | Prior γ grain size (μm) | Tensile strength TS (MPa) | Internal pressure fatigue strength (MPa) | σ** | σ/TS (%) | Remarks |
| 1 | A | M | 90 | 780 | 334 | 295 | 37.8 | Example |
| 2 | B | BF | 200 | 564 | 190 | 168 | 29.7 | Comparative Example |
| 3 | C | BF | 150 | 562 | 230 | 203 | 36.1 | Example |
| 4 | D | BF | 100 | 561 | 230 | 203 | 36.2 | Example |
| 5 | E | BF | 90 | 562 | 240 | 212 | 37.7 | Example |
| 6 | F | BF | 100 | 561 | 230 | 203 | 36.2 | Example |
| 7 | G | BF | 120 | 561 | 230 | 203 | 36.2 | Example |
| 8 | H | BF | 140 | 563 | 230 | 203 | 36.0 | Example |
| 9 | I | BF | 200 | 564 | 180 | 159 | 28.1 | Comparative Example |
| 10 | J | BF | 180 | 562 | 180 | 159 | 28.2 | Comparative Example |
| 11 | K | BF | 120 | 563 | 230 | 203 | 36.1 | Example |
| 12 | L | BF | 100 | 562 | 230 | 203 | 36.1 | Example |
| 13 | M | BF | 90 | 563 | 240 | 212 | 37.6 | Example |
| 14 | N | BF | 100 | 561 | 230 | 203 | 36.2 | Example |
| 15 | O | BF | 150 | 563 | 230 | 203 | 36.0 | Example |
| 16 | P | BF | 190 | 563 | 180 | 159 | 28.2 | Comparative Example |

TABLE 3-continued

| Steel tube No. | Steel No. | Structure: Type of main phase* | Structure: Prior γ grain size (μm) | Tensile properties: Tensile strength TS (MPa) | Internal pressure fatigue resistance: Internal pressure fatigue strength (MPa) | Internal pressure fatigue resistance: σ** | Internal pressure fatigue resistance: σ/TS (%) | Remarks |
|---|---|---|---|---|---|---|---|---|
| 17 | Q | BF | 210 | 562 | 180 | 159 | 28.3 | Comparative Example |
| 18 | R | F + P | 90 | 370 | 159 | 140 | 37.8 | Comparative Example |
| 19 | S | F + P | 90 | 370 | 159 | 140 | 37.8 | Comparative Example |
| 20 | T | BF | 90 | 495 | 212 | 187 | 37.8 | Comparative Example |
| 21 | U | BF | 90 | 560 | 240 | 212 | 37.8 | Example |
| 22 | V | BF | 90 | 565 | 240 | 212 | 37.5 | Example |
| 23 | W | M | 90 | 980 | 420 | 371 | 37.8 | Example |
| 24 | X | B | 90 | 910 | 380 | 335 | 36.8 | Example |
| 25 | Y | B | 90 | 908 | 380 | 335 | 36.9 | Example |
| 26 | Z | M | 90 | 905 | 380 | 335 | 37.0 | Example |

*M: martensite, B: bainite, BF: bainitic ferrite, F: ferrite, P: pearlite

**σ = inner diameter × internal pressure fatigue strength/(2 × wall thickness), where the inner diameter is 3.0 mm and the wall thickness is 1.7 mm.

The seamless steel tubes of all our Examples had high strength, i.e., tensile strengths TS of not less than 500 MPa, and good internal pressure fatigue resistance, i.e., endurance ratios (σ/TS) of not less than 30%, which are sufficient for use as steel tubes for fuel injection in diesel engines. In contrast, the seamless steel tubes of the Comparative Examples had a tensile strength of less than 500 MPa or an internal pressure fatigue resistance σ/TS of less than 30%.

The invention claimed is:

1. A seamless steel tube for fuel injection having a composition comprising, by mass, 0.155% to 0.21% C, 0.01% to 0.49% Si, 1.20% to 2.1% Mn, 0.005% to 0.25% Al, and 0.0010% to 0.010% N and containing, as impurities, 0.030% or less P, 0.025% or less S, and 0.005% or less O, the balance being Fe and incidental impurities, the composition satisfying condition (1):

$$[\text{Al }\%]\times[\text{N }\%]\leq 27\times10^{-5} \quad (1)$$

wherein Al % and N % are the contents (% by mass) of Al and N, respectively, the steel tube having a structure with an average prior γ grain size of 150 μm or less in an axial cross-section after cold drawing and heat treatment, and a tensile strength TS of 500 MPa or more.

2. The seamless steel tube according to claim 1, wherein the composition further comprises, by mass, at least one of 0.70% or less Cu, 1.00% or less Ni, 1.20% or less Cr, 0.50% or less Mo, and 0.0060% or less B.

3. The seamless steel tube according to claim 1, wherein the composition further comprises, by mass, at least one of 0.20% or less Ti, 0.050% or less Nb, and 0.20% or less V.

4. The seamless steel tube according to claim 2, wherein the composition further comprises, by mass, at least one of 0.20% or less Ti, 0.050% or less Nb, and 0.20% or less V.

5. The seamless steel tube according to claim 1, wherein the composition further comprises, by mass, 0.0040% or less Ca.

6. The seamless steel tube according to claim 2, wherein the composition further comprises, by mass, 0.0040% or less Ca.

7. The seamless steel tube according to claim 3, wherein the composition further comprises, by mass, 0.0040% or less Ca.

8. The seamless steel tube according to claim 4, wherein the composition further comprises, by mass, 0.0040% or less Ca.

* * * * *